US007355610B2

(12) United States Patent
Soroushi

(10) Patent No.: US 7,355,610 B2
(45) Date of Patent: Apr. 8, 2008

(54) METHOD AND APPARATUS FOR EXPANDING IMAGE DATA TO CREATE ENLARGED IMAGES FOR DISPLAY

(75) Inventor: Atousa Soroushi, North Vancouver (CA)

(73) Assignee: Seiko Epson Corporation, Tokyo (JP)

( * ) Notice: Subject to any disclaimer, the term of this patent is extended or adjusted under 35 U.S.C. 154(b) by 681 days.

(21) Appl. No.: 10/926,732

(22) Filed: Aug. 26, 2004

(65) Prior Publication Data

US 2006/0050093 A1 Mar. 9, 2006

(51) Int. Cl.
*G09G 5/00* (2006.01)

(52) U.S. Cl. ..... 345/667; 382/298

(58) Field of Classification Search ..... 382/298, 382/293; 345/667
See application file for complete search history.

(56) References Cited

U.S. PATENT DOCUMENTS 5,097,518 A * 3/1992 Scott et al. ..... 382/298
5,113,455 A * 5/1992 Scott ..... 382/298
5,751,283 A * 5/1998 Smith ..... 715/798
6,459,822 B1 * 10/2002 Hathaway et al. ..... 382/296
6,529,642 B1 * 3/2003 Lai et al. ..... 382/298
6,771,811 B1 * 8/2004 Walmsley et al. ..... 382/162
7,155,069 B2 * 12/2006 Ishizaka ..... 382/298
2003/0179953 A1 * 9/2003 Ishizaka ..... 382/298

* cited by examiner

*Primary Examiner*—Samir Ahmed
*Assistant Examiner*—Stephen R Koziol
(74) *Attorney, Agent, or Firm*—Mark P. Watson

(57) ABSTRACT

In a method, a plurality of scale factors and a plurality of sets of pixel replication sequences are provided. A scale factor, a pixel replication sequence, a first pixel of an original image, and a scale offset parameter are selected. The selected first pixel is mapped into a first pixel location in an enlarged image. The selected scale factor and scale offset are added, producing a first sum. The first sum is compared to a maximum sum. If the first sum is less than the maximum sum, the selected first pixel is also mapped into a second pixel location. Otherwise, a second pixel is selected from the original image and mapped into the second pixel location.

25 Claims, 7 Drawing Sheets

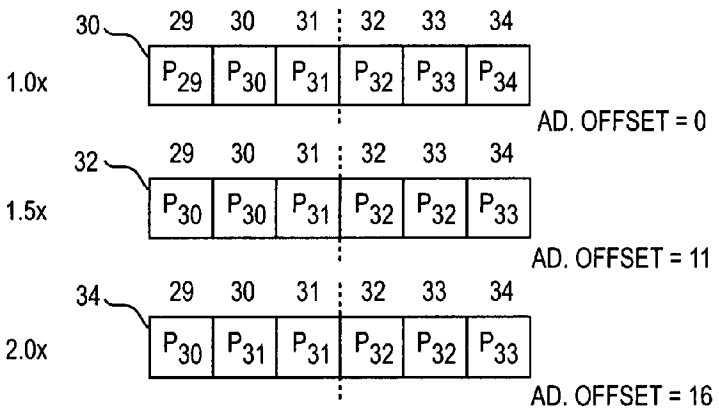
FIG. 3
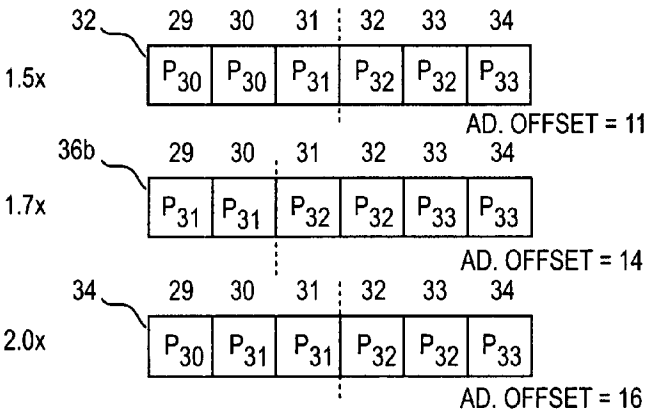
FIG. 5
FIG. 4
FIG. 6

METHOD AND APPARATUS FOR EXPANDING IMAGE DATA TO CREATE ENLARGED IMAGES FOR DISPLAY

FIELD OF INVENTION

The invention is related to the field of digital image processing. In particular, the invention is directed to expanding digital image data to create enlarged images for display, the images being enlarged by varying degrees and in a way in which a selected pixel, such as a central pixel, in an original image is maintained at a particular location in each of the enlarged images regardless of the scale factor used.

BACKGROUND

Digital images have become commonplace. They are displayed on the display screens employed in computer systems and televisions, such as CRTs and LCDs. They are printed as hard copy on media with devices like laser and inkjet printers.

Digital devices can be used to zoom in or out on an object in a digital image. A camera, digital television, a cellular telephone, personal digital assistant, a computer, or other digital device enlarges a selected portion of the original image by creating a new image from that portion. Digital images are comprised of arrays of pixels and the enlarged image is made up of pixels from the selected portion of the original. A pixel is a small, discrete element in the display screen that can be illuminated with a particular color and degree of brightness. The term pixel is also used to refer to the datum that define the color and intensity of the physical pixels in the display device. Each pixel in the selected portion of the original image appears once. In the enlarged image, however, each pixel from the selected portion of the original image appears at least once and may appear more than once.

In practice, it is not uncommon for a viewer to repeatedly scale an image using different scale factors. The scale factor indicates the degree of enlargement. A scale factor of 2× doubles the size of the image. A scale factor of 1.5× enlarges the image by 50 percent, and so on. The viewer may enlarge a selected portion of an image by 2×, but see that it is too big. The viewer may then enlarge the portion by 1.5×, but see that it is not quite big enough. In a trial and error fashion, the viewer may repeatedly scale the selected portion seeking the optimum resolution for viewing.

When repeatedly enlarging a selected portion of an image, it is desirable to maintain the center of the selected portion at the center of each enlarged image. If the central pixels are not so maintained, objects in the successive enlarged images may appear to jitter. A jittering object is an object that appears to move irregularly in small amounts up, down, or sideways. Image jitter annoys and distracts the viewer.

Image jitter is not a problem if the pixels at the center of the selected portion all have the same color and intensity. Jitter is perceptible where there are transitions in color or intensity in the selected portion of the original. For instance, consider a portion of an image of the same color and intensity, such as a patch of clear blue sky. Image jitter is unlikely when repeatedly enlarging such a portion. On the other hand, consider a portion of an image having a black line in the middle of it, such as a border, on a white background. The line may define a portion of text, a border on a dialog box, or the edge of an object. The line may be only one pixel wide. Repeatedly enlarging this portion may result in image jitter. There is no way to know the composition of the pixels of the selected portion in advance. But it is portions with transitions, such as those in the second example, that are typically of interest to the viewer.

When an original image is enlarged repeatedly, the central pixels of the original image may or may not be maintained at the center of the enlarged image. Whether the central pixels of the original image are maintained at the center of the enlarged image depends on the scale factor. For some scale factors, the central pixel in the enlarged image will be the same as the central pixel in the original image. But for other scale factors, the central pixel of the original image will be shifted in the enlarged image. Again, there is no way to know the scale factors the viewer will choose in advance.

Accordingly, there is a need for a method and apparatus for expanding digital image data to create enlarged images for display, the images being enlarged by varying degrees and in a way in which a selected pixel, such as a central pixel, in an original image is maintained at a particular location in each of the enlarged images regardless of the scale factor used.

SUMMARY

A preferred embodiment of the invention is directed to a method for expanding image data for display in which enlarged images are created from an original image. According to the method, a plurality of scale factors are provided. Each scale factor defines a particular degree of scaling the original image. A plurality of sets of pixel replication sequences are also provided. One set of pixel replication sequences is provided for each of the scale factors and each set includes at least two pixel replication sequences. A scale factor is selected from the plurality of provided scale factors. A pixel replication sequence is selected from the set of pixel replication sequences for the selected scale factor. The pixel replication sequence is preferably selected so that a selected one of the pixels in the original image is mapped to a particular location in the enlarged image.

According to the method, a plurality of sets of pixel replication sequences are provided. Providing the sequences includes: selecting a first pixel of the original image, selecting a scale offset parameter, adding the selected scale factor to the selected scale offset, producing a first sum, and comparing the first sum to a maximum sum.

The selected first pixel of the original image is mapped into a first pixel location in the enlarged image. The result of the addition is used to determine the pixel to be mapped into a second location in the enlarged image. If the first sum is less than the maximum sum, the selected first pixel is mapped into the second pixel location. If the first sum is greater than the maximum sum, a second pixel is selected from the original image and mapped into the second pixel location.

The invention is also directed to a machine readable medium. The medium is embodies a program of instructions that may be executed by a machine. When executed, the machine performs a method in accordance with the principles of the invention.

In addition, a preferred embodiment of the invention is directed to an apparatus for expanding image data for display in which enlarged images are created from an original image. The apparatus includes an enlarging circuit. The enlarging circuit generates sets of pixel replication sequences. Preferably, the enlarging circuit is adapted to generate one set of sequences for each of a plurality of scale factors. Each set of sequences preferably includes at least two pixel replication sequences. The apparatus also includes a mapping circuit for mapping pixels into an enlarged image. The mapping circuit maps pixels according to a selected pixel replication sequence. The pixel replication sequences for each scale factor maps a selected one of the pixels in the original image into a particular location in the enlarged image. Preferably, at least one of the pixel replication sequences maps a selected pixel in the original image into a particular location in each of a plurality of enlarged images such that the selected pixel is maintained at the particular location at regardless of the scale factor used. The apparatus in a preferred embodiment also includes a memory for storing an original image. The mapping circuit maps pixels from the memory into the enlarged image.

The invention is also directed to a computer system that includes an apparatus for expanding image data for display.

DESCRIPTION OF THE DRAWINGS

FIG. 3 illustrates an original image and two enlarged images.

FIGS. 4, 5, and 6 each illustrate three enlarged images.

DETAILED DESCRIPTION OF A PREFERRED EMBODIMENT

Figure 2:
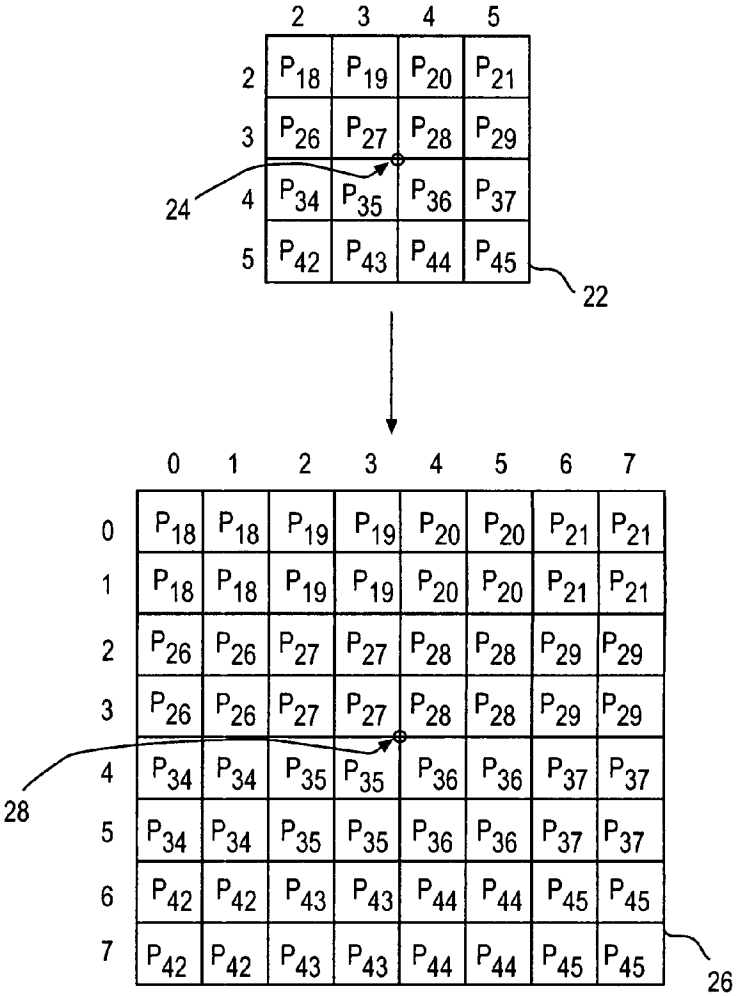
(PRIOR ART) FIG. 2
FIG. 2 illustrates a portion of the image of FIG. 1 and an enlarged image.

The invention is directed to a method and apparatus for expanding digital image data to create enlarged images for display, the images being enlarged by varying degrees and in a way in which a selected pixel, such as a central pixel, in an original image is maintained at a particular location in each of the enlarged images regardless of the scale factor used. This specification describes the present preferred embodiments of the invention, examples of which are illustrated in the accompanying drawings. Whenever possible, the same reference numbers are used in the drawings and specification to refer to the same or like parts, blocks, and steps.

Figure 1:
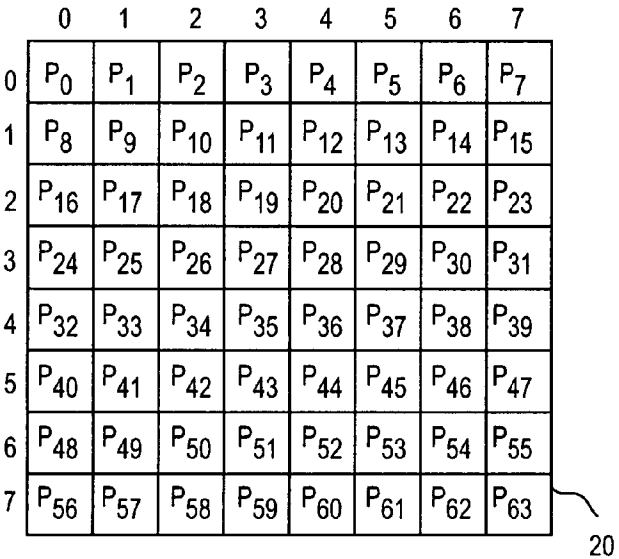
(PRIOR ART) FIG. 1
FIG. 1 is a representation of a digital image.

FIG. 1 is a representation of a digital image 20. FIG. 1 shows that these images are comprised of arrays of pixels. The column and row coordinates of pixel locations of the image 20 are given by the numbers to the top and side of the image. The image 20 has 64 pixels: $P_0$ to $P_{63}$. For example, pixel $P_{35}$ is mapped into the pixel location defined by column 3 and row 4.

FIG. 2 illustrates creating an enlarged image by doubling the image data. A desired portion of pixels from the original image 20 are selected. The pixels selected for enlargement are designated by reference number 22 and are replicated in the enlarged image 26. For example, pixel $P_{35}$ is replicated four times, twice horizontally and twice vertically. Reference arrow 24 shows the center of the selected pixels 22. Reference arrow 28 shows the center of the enlarged image 26. The position of the central pixels $P_{27}$, $P_{28}$, $P_{35}$, and $P_{36}$ in the original image 20 are maintained at the same relative positions in the enlarged image 26.

In the example of FIG. 2, pixels are replicated in both the horizontal and vertical dimensions. An example showing pixels replicated in one dimension illustrates the other dimension as well. To simplify the explanations provided in this specification, one dimensional examples are typically provided. But it should be understood that these examples are intended to illustrate both horizontal and vertical dimensions.

FIGS. 3-6 assume a one-dimensional original image 30 comprised of one row of 64 pixels ($P_0$ to $P_{63}$). FIGS. 3-6 assume that this original image 30, or an enlarged portion, is displayed on a one-dimensional display device having 64 pixel locations (columns 0-63, row 0). In FIGS. 3-6, only the central portion of the display device is shown, specifically, only pixel locations 29-34. While it is assumed in this specification that the original and enlarged images are displayed on a display device, this assumption is for convenience of explanation only. In explanations, references to pixel locations in a display device are also intended to refer to pixel locations in an original or enlarged image.

FIGS. 3-5 illustrate the results a viewer might obtain when repeatedly enlarging an original image using different scale factors.

FIG. 3 shows central portions of an original image and two images enlarged at different scale factors. In the original image 30, each pixel is positioned at its respective like-numbered pixel location in the display. For example, the central pixels $P_{31}$ and $P_{32}$ are positioned in central locations 31 and 32. In enlarged image 32, the original image is enlarged using a scale factor of 1.5× and the central pixels $P_{31}$ and $P_{32}$ in the original image 30 are maintained at locations 31 and 32 in the display. In image 34, the original image is enlarged by 2.0×. Again, the central pixels $P_3$, and $P_{32}$ in the original image 30 are maintained at locations 31 and 32. The boundary between central pixels $P_{31}$ and $P_{32}$ is highlighted in FIGS. 3-6 with a vertical dashed line.

As mentioned, whether the central pixels of the original image are maintained at the center of the enlarged image depends on the scale factor. For some scale factors, such as those shown in FIG. 3, the central pixel in the enlarged image will be the same as the central pixel in the original image.

FIGS. 3-6 show an associated "AD. OFFSET" for each image. If the original line is 64 pixels wide and the entire line is enlarged by 1.5×, the enlarged image will have 96 pixels. As the display device is only 64 pixels wide, only a portion of the original line can be displayed. For a scale factor of 1.5×, it is necessary to select 42.66 pixels for enlargement. But pixels are discrete, so it is necessary to select either 42 or 43 pixels. For example, 43 pixels are selected for enlargement in image 32, even though only 4 of these pixels are shown in the figure.

The address offset (or AD OFFSET) specifies the memory location of the first pixel in the original image to be included in the enlarged image. With reference to FIGS. 3-6, it is assumed that the original image is stored in a memory similar to the assumed display device, that is, a one-dimensional memory having 64 pixel locations (columns 0-63, row 0). The address offset of the original image 30 is zero, indicating that the first pixel displayed is stored in the first pixel location in memory. In this example, the pixel stored in the first pixel location in memory is also the first pixel in the image. As another example, the address offset of enlarged image 32 is 11, indicating that the pixel $P_{11}$ is the first pixel appearing in the image 32.

FIGS. 4 and 5 illustrate the problem to be solved.

FIG. 4 shows another sequence of enlarged images. In FIG. 4, the viewer has enlarged the original image by 1.5×, 1.7×, and then 2.0×. In enlarged images 32 and 34, as mentioned with respect to FIG. 3, the central pixels are maintained at the central locations. But in enlarged image 36*a*, where a scale factor of 1.7× is used, the central pixels shift to the right. Pixels $P_{31}$ and $P_{32}$ appear at pixel locations 32 and 33.

The address offset for image 36*a* is 13, indicating that $P_{13}$ is the first pixel appearing in the image. It might be thought that if the portion to be enlarged were carefully selected the central pixels could be maintained at the central locations. In other words, because the address offset partially defines the portion of the original image to be enlarged, it might be thought possible to maintain the central pixels at the central locations by carefully choosing the address offset. As shown in FIG. 5, however, this is not possible.

FIG. 5 shows the same sequence of enlarged images shown in FIG. 4, except that image 36*b* is substituted for image 36*a*. Both images 36*a* and 36*b* enlarge the original image by 1.7×. The images differ in the choice of address offset. In image 36*a* the address offset is 13; in image 36*b* the address offset is 14. In image 36*a*, the central pixels shift to the right. In image 36*b*, the central pixels shift to the left. FIG. 5 illustrates that even when an attempt is made to choose the address offset carefully, maintaining the central pixels in the central locations is not possible.

To summarize, FIGS. 4 and 5 show one example of the problem encountered when repeatedly enlarging an image using different scale factors: Image jitter can result. Further, image jitter may not be eliminated simply by adjusting the portion of the original image to be enlarged. The inability to position the central pixels at the central locations is a significant problem. The invention solves this problem and eliminates image jitter.

FIG. 6 illustrates a solution to the image jitter problem according to the principles of the invention. FIG. 6 shows the same sequence of enlarged images shown in FIGS. 4 and 5. Image 36*c* in FIG. 6 is enlarged by 1.7×, just as images 36*a* and 36*b*. Unlike images 36*a* and 36*b*, the central pixels are maintained at the central locations in image 36*c*. This is accomplished by employing a novel and innovative scale offset parameter. In the example, an address offset of 14, together with a scale offset of 50, is used to create enlarged image 36*c*.

The innovative scale offset may be employed in a method or in an apparatus. Its application in an apparatus is first described.

Figure 7:
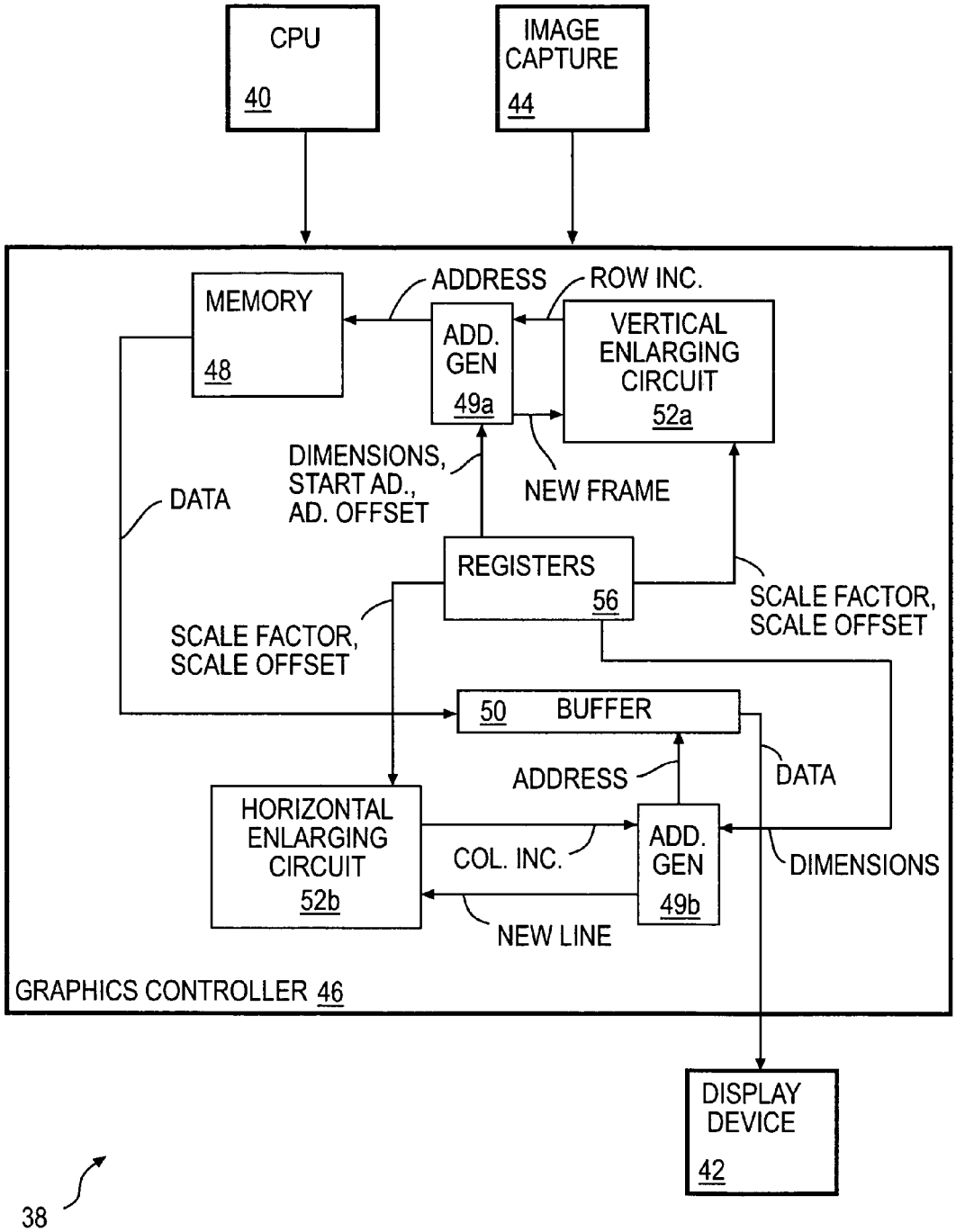
FIG. 7 illustrates a computer system having enlarging circuits and a memory according to the invention.

FIG. 7 illustrates a computer system 38 that incorporates the principles of the invention. The computer system 38 may be a camera, digital television, a cellular telephone, personal digital assistant, or other digital device. The computer system 38 includes a CPU 40, a display device 42, an image capture device 44, and a graphics controller 46, though other components may and typically are also included.

The portions of the graphics controller 46 pertinent to a preferred embodiment of the invention are shown in FIG. 7. Again, other components may and typically are included in the graphics controller 46. The graphics controller 46 preferably includes an embedded memory 48 for storing an original image, a buffer 50 for buffering image data, and vertical and horizontal enlarging circuits 52*a*, 52*b* for expanding image data. The graphics controller 46 also includes registers 56 used for storing parameters described below.

Typically, the CPU 40 writes the scale factor, dimension parameters, and scale offset to the registers 56. In a preferred embodiment, an original image is stored in the memory 48 by the CPU 40 or the image capture device 44. However, any device capable of transferring image data may be substituted. The memory is typically, though not necessarily, of a size larger than required to store the original image. The original image is typically stored in raster sequence (though this is not required). A raster order is the order in which the display device refreshes the pixels in the display screen. Raster order proceeds from side to side and from top to bottom. After an original image is stored in the memory 48, it is transferred to the buffer 50 and from the buffer 50 to the display device.

The graphics controller 46 includes a circuit 49*a* for generating memory addresses and a circuit 49*b* for specifying buffer addresses. The address generating circuit 49*a* is used to specify the addresses of pixels to be transferred from the memory 48 to the buffer 50. The address generating circuit 49*b* is used to specify the addresses of pixels to be transferred from the buffer 50 to the display device 42. The operation of circuits 49*a* and 49*b* is described later in this specification.

The memory 48 may have image data written to it or read from it at a memory clock frequency of MCLK. The buffer 50 is capable of having data written to it at the MCLK frequency. In addition, the buffer 50 is also capable of having data read from it at a pixel clock frequency PCLK.

In operation of the graphics controller 46, image data is written to the memory 48 at the MCLK frequency. Image data is also read from the memory 48 and written to the buffer 50 at the MCLK frequency. Image data is transferred from the buffer 50 to the display device 42 at the PCLK frequency.

Typically, MCLK is a higher frequency than PCLK. The dual frequency data transfer capability allows the buffer to be rapidly filled with image data and emptied at a rate that is relatively slow. While the buffer is being emptied, other devices may access the memory. But when the buffer starts getting near empty, it is rapidly refilled at the MCLK rate. By using the buffer 50 to transfer data to the display device 42, the display device is never starved of image data.

The registers 56 store the scale factor and the novel scale offset. Different scale factors and scale offsets may be stored for horizontal and vertical scaling. In addition, the registers 56 store the address of the first raster-ordered pixel in the original image (the "start address"), the address offset (for specifying the first raster-ordered pixel in the portion of the original image that is to be enlarged), and the dimensions of the enlarged image. These positional and dimensional parameters may be illustrated with reference to FIG. 8.

Figure 8:
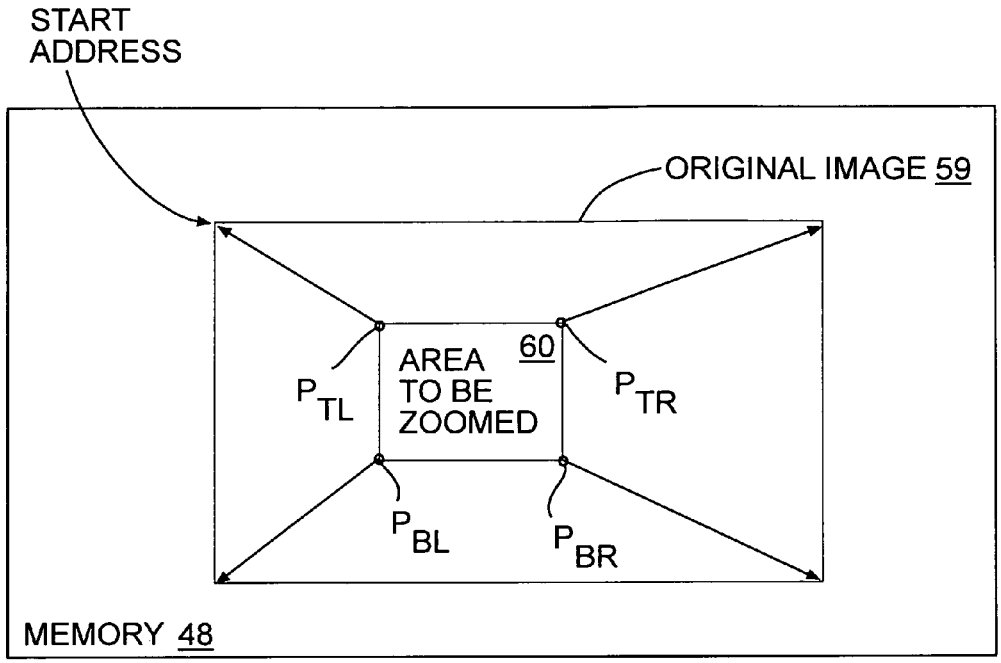
FIG. 8 illustrates an image stored in the memory of FIG. 7.

FIG. 8 shows an original image 59 and a portion 60 of the original selected for enlargement. The original image 59 and the portion 60 are stored in the memory 48. The original image 59 is stored in raster order. As shown in FIG. 8, the start address is the address of the left-most pixel on the first line of the original image 59. The portion 60 has right and left corner pixels at the top and bottom of the portion: $P_{TL}$, $P_{TR}$, $P_{BL}$, and $P_{BR}$, as shown. The first pixel in the portion 60 is the pixel $P_{TL}$. The memory location of the first pixel $P_{TL}$ is given by the start address plus an address offset. The address offset specifies the distance between the start address and the first pixel $P_{TL}$. The horizontal dimension of the portion 60 is the distance between the first pixel $P_{TL}$ and the top-right corner pixel $P_{TR}$, specified by number of columns. The vertical dimension of portion 60 is the distance between the first pixel $P_{TL}$ and the bottom-left corner pixel $P_{BL}$, specified by the number of rows.

After the original image is stored in the memory 48, any pixel can be fetched by specifying its memory address. As mentioned, the address generating circuit 49*a* is used to specify the addresses of pixels to be transferred from the memory 48 to the buffer 50. The address generating circuit 49*a* sends one address to the memory 48 during each MCLK cycle when filling the buffer 50. Generally, the address generating circuit 49*a* sends the addresses in raster order.

Raster order, in this specification, can also refer to an order for pixels in an image (or portion of an image) that proceeds from side to side and from top to bottom. Thus, when the address generating circuit 49*a* sends addresses for a selected portion 60 of an image 59, it sends these addresses in a raster order with respect to the selected portion 60.

To illustrate operation of the address generating circuit 49*a*, consider the transfer, without enlargement, of an entire original image from memory 48 to the buffer 50. The address generating circuit 49*a* sends the memory 48 the address of each pixel exactly once, sending the addresses in raster sequence.

Operation of the address generating circuit 49*a* is modified by the vertical enlarging circuit 52*a* when an image is enlarged. Normally, the address generating circuit 49*a*, after it reaches the end of one row, begins sending addresses for a new row. When an image is to be enlarged, the vertical enlarging circuit 52*a* modifies the operation of the address generating circuit 49*a* by sending it a row increment signal, which controls whether addresses for a new row are sent.

When an image is expanded vertically, some rows appear in the enlarged image more than once. The vertical enlarging circuit 52*a*, as the address generating circuit 49*a* sends the memory address for the last pixel in a line, either asserts or does not assert the row increment signal.

If a row of pixels is to appear in the enlarged image one time, the vertical enlarging circuit 52*a* asserts the row increment signal, causing the address generating circuit 49*a* to proceed in normal raster sequence, sending addresses for a new row.

On the other hand, if the row of pixels is to appear in the enlarged image more than once, the vertical enlarging circuit 52*a* does not assert the row increment signal, modifying the sequence in which the address generating circuit 49*a* sends addresses. Instead, of following the last (right-most) pixel in the row with the first pixel in the next lower row, the address generating circuit 49*a* sends the address of the first pixel in the same row. By not asserting the row increment signal, the vertical enlarging circuit 52*a* causes the address generating circuit 49*a* to repeat the sending of memory addresses for the same row.

In operation, the vertical enlarging circuit 52*a* reads the scale factor and the scale offset, and the address generating circuit 49*a* reads the start address, the address offset, and the dimensions of the portion 60 from the registers 56. The address generating circuit 49*a* uses the start address and the address offset it reads to establish the first memory address it will generate. The address generating circuit 49*a* counts the number of addresses it generates and uses the dimensions of the portion 60 to determine when it has sent the last address in a line and the last row in the portion. The address generating circuit 49*a* sends a new frame signal to the vertical enlarging circuit 52*a* when it determines it has sent the last row in the image portion 60.

The address generating circuit 49*b* is used to specify the addresses of pixels to be transferred from the buffer 50 to the display device 42. The operation of circuit 49*b* and the horizontal enlarging circuit 52*b* is next described.

After a row of pixels is stored in the buffer 50, a pixel can be transferred to the display device 42 by specifying its buffer address. The address generating circuit 49*b* sends one address to the buffer 50 during each PCLK cycle when pixels are being written to the display device 42. Generally, the address generating circuit 49*b* sends addresses to the buffer 50 sequentially from the left-most to the right-most pixel in a row.

To illustrate operation of the address generating circuit 49*b*, consider the transfer, without enlargement, of a row of pixels from buffer 50 to the display device 42. The address generating circuit 49*b* sends the buffer 50 the address of each pixel exactly once, sending the addresses in a left-to-right sequence.

Operation of the address generating circuit 49*b* is modified by the horizontal enlarging circuit 52*b* when an image is enlarged. Normally, the address generating circuit 49*b*, after it sends the address for one pixel, increments its address output so that the next address it sends is for the next pixel in the row. When an image is to be enlarged, the horizontal enlarging circuit 52*b* modifies the operation of the address generating circuit 49*b* by sending it a column increment signal, which controls whether the address generating circuit 49*b* increments the address it sends to the buffer 50.

When an image is expanded horizontally, at least some of the pixels in a row appear in the enlarged image more than once. The horizontal enlarging circuit 52*b*, after the address generating circuit 49*b* sends the buffer address for each pixel in a row, either asserts or does not assert the column increment signal.

If a particular pixel is to appear in the enlarged row just one time, the horizontal enlarging circuit 52*b* asserts the column increment signal, causing the address generating circuit 49*b* to increment in normal fashion, sending on the next PCLK an address for the next pixel.

On the other hand, if the pixel is to appear in the enlarged image more than once, the horizontal enlarging circuit 52*b* does not assert the column increment signal, modifying the sequence in which the address generating circuit 49*b* sends addresses. Instead, of incrementing and sending an address for the next pixel in the row, the address generating circuit 49*b* does not increment the buffer address, again sending the address of the same pixel in the same row. By not asserting the column increment signal, the horizontal enlarging circuit 52*b* causes the address generating circuit 49*b* to repeat the sending of memory address for the same pixel.

In operation, the horizontal enlarging circuit 52*b* reads the scale factor and the scale offset from the registers 56, and the address generating circuit 49*b* reads the dimensions of the portion 60 from the registers 56. The address generating circuit 49*b* counts the number of addresses it generates and uses the dimensions of the portion 60 to determine when it has sent the address for the last pixel in a row. The address generating circuit 49*b* sends a new line signal to the horizontal enlarging circuit 52*b* when it determines it has sent the last pixel in a row and triggered the address calculation for the next row.

Figure 9:
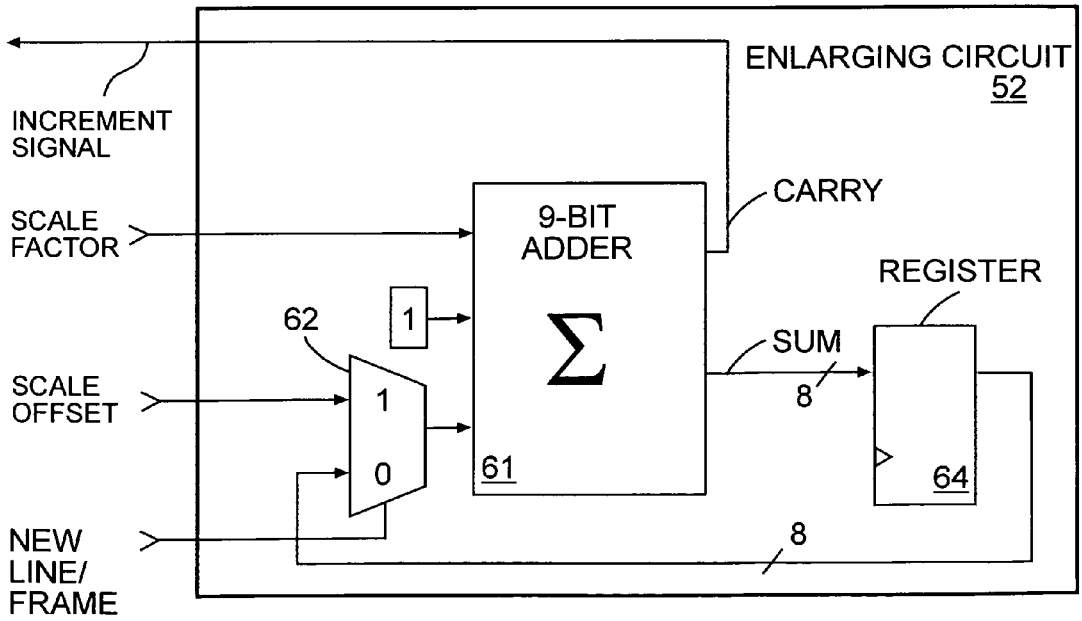
FIG. 9 illustrates the enlarging circuits of FIG. 7.

FIG. 9 illustrates one preferred embodiment of the enlarging circuits 52*a*, 52*b*. The vertical enlarging circuit 52*a* and the horizontal enlarging circuit 52*b* are structured similarly and will be explained together as enlarging circuit 52, with significant differences being noted. The enlarging circuit 52 employs a 9-bit digital adder circuit 61 for adding 8-bit binary numbers. The adder circuit sums three inputs and outputs an 8-bit sum and a carry-out bit. A first input is the scale factor stored in the registers 56. A second input is the integer one. The third input is the output of a multiplexer 62. The enlarging circuit 52 also includes an output sum register 64, which is coupled to the 8-bit sum output of the adder 61.

The inputs to the enlarging circuit 52 include the scale factor and the scale offset stored in the registers 56, and the new line/frame signal from the respective address generating circuits. The outputs of the enlarging circuit 52 include the row/column increment signal, which is coupled to the respective address generating circuits 49*a*, 49*b*.

In operation, the enlarging circuit 52 repeatedly evaluates the expression: scale factor+1+previous sum. After each addition, the adder 61 produces a sum and a carry-out bit. For hexadecimal sums greater than FFh (255 decimal), the carry-out bit is a 1; otherwise it is zero. If the addition results in a carry-out of 1, the increment signal is asserted. For vertical enlarging circuit 52*a*, the increment signal is the row increment signal, causing the address generating circuit 49*a* to generate a memory address for the next row in an image portion. For horizontal enlarging circuit 52*b*, the increment signal is the column increment signal, causing the address generator 49*b* to generate a buffer address for the next pixel in a row. If no carry results, the increment signal is not asserted and the address generators 49*a*, 49*b* are not incremented.

How the enlarging circuit 52 and the address generating circuits 49*a*, 49*b* work together to expand image data is presented in an example below. The example uses the scale factor of 1.5×, which increases the number of pixels by 50 percent, and the image is expanded horizontally.

| | Result | Carry | Output |
|---|---|---|---|
| Initial State | | | P0 |
| A9h + 1 = | Aah | No | P0 |
| A9h + 1 + AAh = | 154h | Yes | P1 |
| A9h + 1 + 55h = | FFh | No | P1 |
| A9h + 1 + FFh = | 1A9h | Yes | P2 |
| A9h + 1 + A8h = | 154h | Yes | P3 |
| A9h + 1 + 154h = | FFh | No | P3 |
| A9h + 1 + FFh = | 1A9 | Yes | P4 |
| A9h + 1 + 1A9h = | 154h | Yes | P5 |
| A9h + 1 + 154h = | FFh | No | P5 |
| A9h + 1 + FFh = | 1A9h | Yes | P6 |

This example assumes that the first pixel $P_0$ of the original image is the first pixel in the enlarged image, as the address initially addressed is for pixel $P_0$. But often this is not the case. As mentioned above with reference to FIG. 8, the corner pixel $P_{TL}$ is commonly the first pixel addressed in the enlarged image.

This example also assumes that the novel scale offset is zero. For the first addition in the above example, the scale factor+1+zero is summed. For the first addition, the enlarging circuit 52 asserts the line/frame signal, causing the multiplexer 62 to select its scale offset input. In the example, the scale offset stored in the registers 56 is zero. After the initial addition, the enlarging circuit 52 de-asserts the new line/frame signal causing the multiplexer 62 to select its register 64 input.

FIGS. 3-6 are also examples illustrating the operation of the enlarging and address generating circuits. The enlarged images 32, 34, 36*a*, and 36*b* may be created with a scale offset equal to zero. In the enlarged images 32 and 34 the central pixels are positioned at the central locations with a scale offset of zero. But in the enlarged images 36*a* and 36*b* the central pixels are not positioned at the central locations with a scale offset of zero. An advantage of the invention is that the enlarging circuit 52, when provided with a scale factor of 1.7× and a scale offset of 50, produces enlarged image 36*c* having the central pixels positioned at the central locations.

The enlarging circuit 52 creates an enlarged image for every scale factor between 1 and FF hexadecimal. For every scale factor, the enlarging circuit 52 selects pixels to be sent to the display device one or more times in the selected portion of the original image. This may be expressed more generally in another way. Enlarged images are created according to the invention by generating a sampling pattern, which is applied to an original image stored in memory. Further, for each scale factor and scale offset, a sampling pattern is created. According to the invention, preferably a set of at least two sampling patterns are created for each scale factor.

When the sampling pattern generated by the enlarging circuit 52 is applied to the pixel data stored in memory, the sequence of pixels sent to the display device is referred to in this specification as a pixel replication sequence. In general terms, the invention permits the selection of a sampling pattern from the set of at least two such patterns for a particular scale factor that produces a pixel replication sequence in which a selected pixel in an original image may be positioned at a predetermined location in an enlarged image.

Having described an embodiment of an apparatus, a preferred embodiment of a method according to the invention is next described with reference to FIGS. 10-12.

Figure 10:
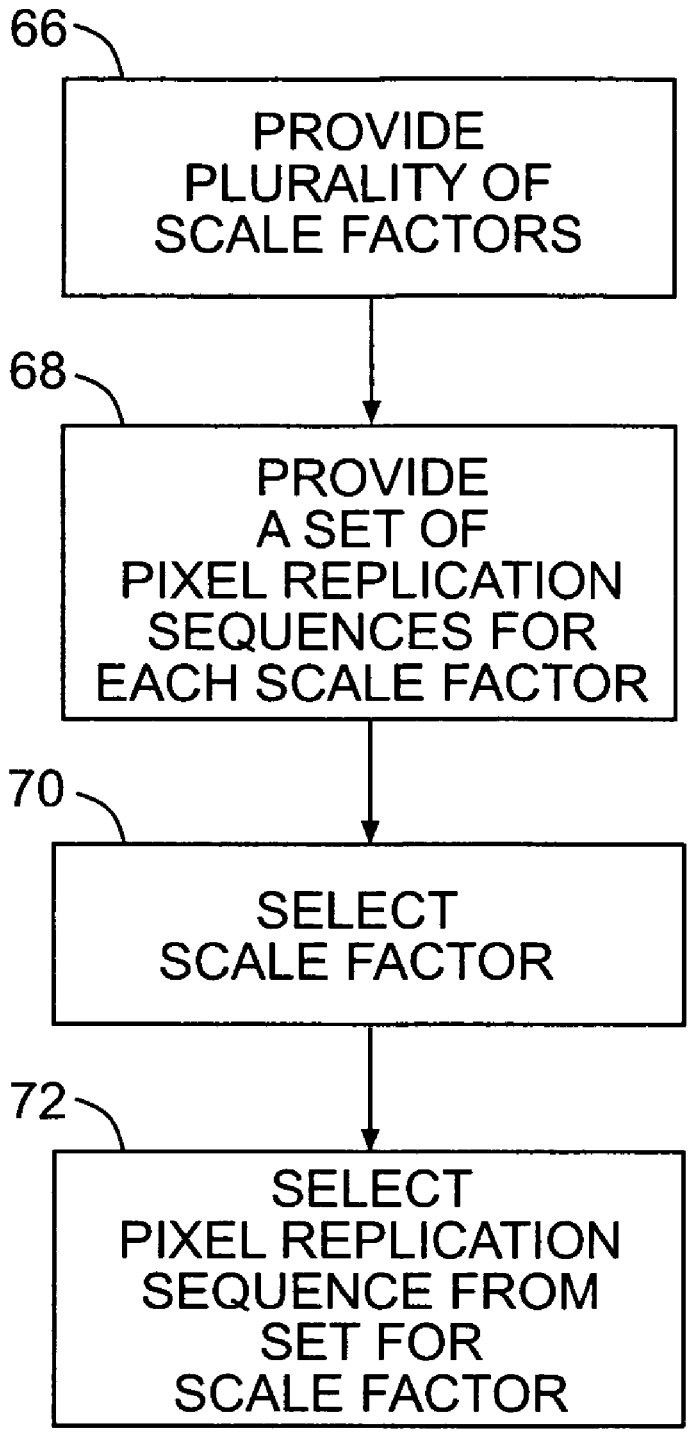
FIG. 10 illustrates a method including a step of providing pixel replication sequences according to the invention.
Figure 11:
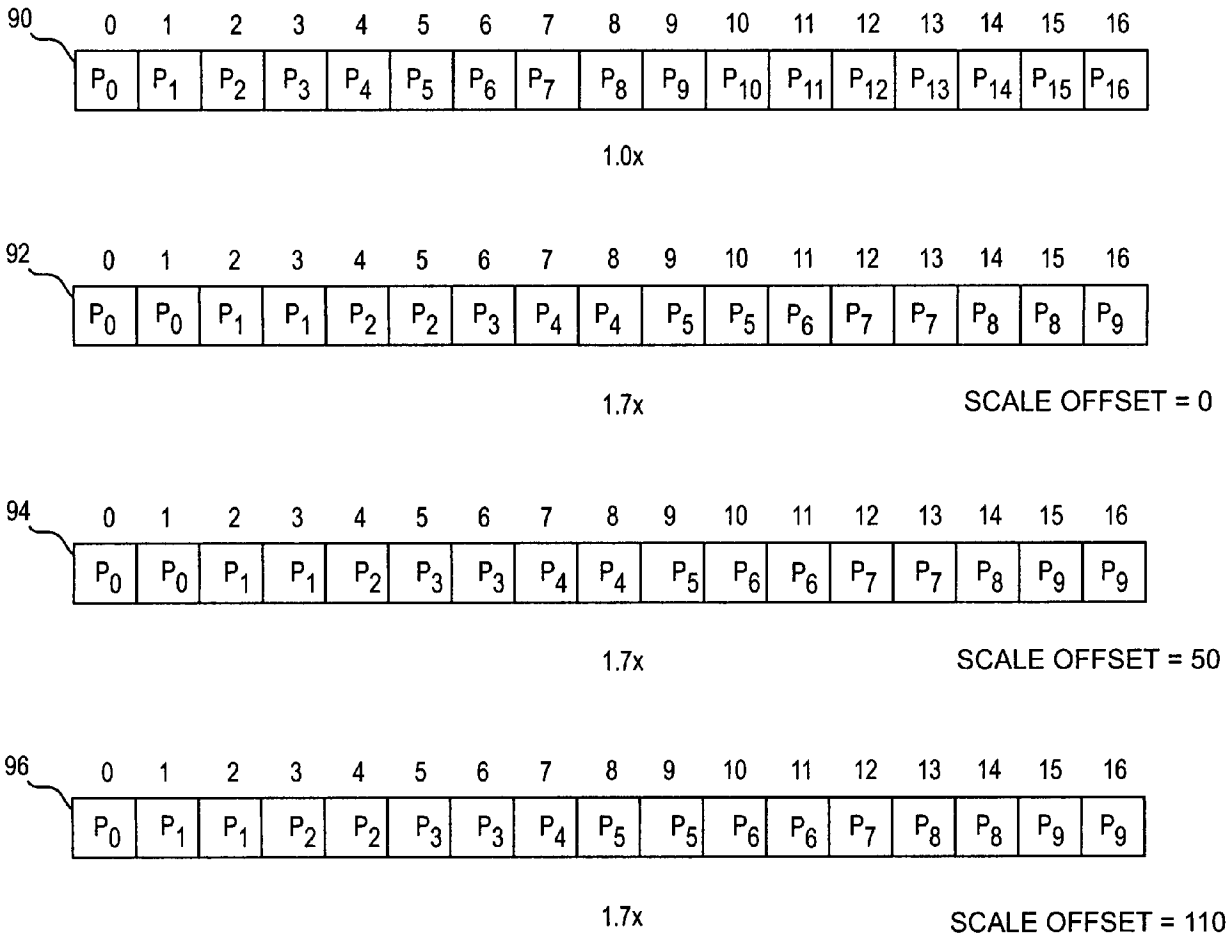
FIG. 11 illustrates an original image and three pixel replication sequences according to the invention.

Referring to FIG. 10, in a step 66, a plurality of scale factors are provided. For example, the scale factors: 1.1×, 1.2×, 1.3×, 1.4×, 1.5×, 1.6×, 1.7×, 1.8×, and 1.9× are provided.

In a step 68, a set of pixel replication sequences are provided for each of the scale factors. For example, as shown in FIG. 11, for original image 90 and scale factor 1.7×, the set comprising the three pixel replication sequences 92, 94, 96 are provided. Preferably, each set includes at least two pixel replication sequences.

In a step 70, a scale factor is selected. For instance, the scale factor 1.7× is selected.

In a step 72, one of the pixel replication sequences from the set of pixel replication sequences for the selected scale factor is selected. For example, pixel replication sequence 94 is selected from the pixel replication sequences for the selected scale factor of 1.7× shown in FIG. 11. Preferably, the pixel replication sequence is selected so that it maintains a selected one of the pixels in the original image at a particular location on the display. For example, the pixel replication sequence 36*c* described in a previous example may be selected as it maintains a selected pixel at a particular location.

Figure 12:
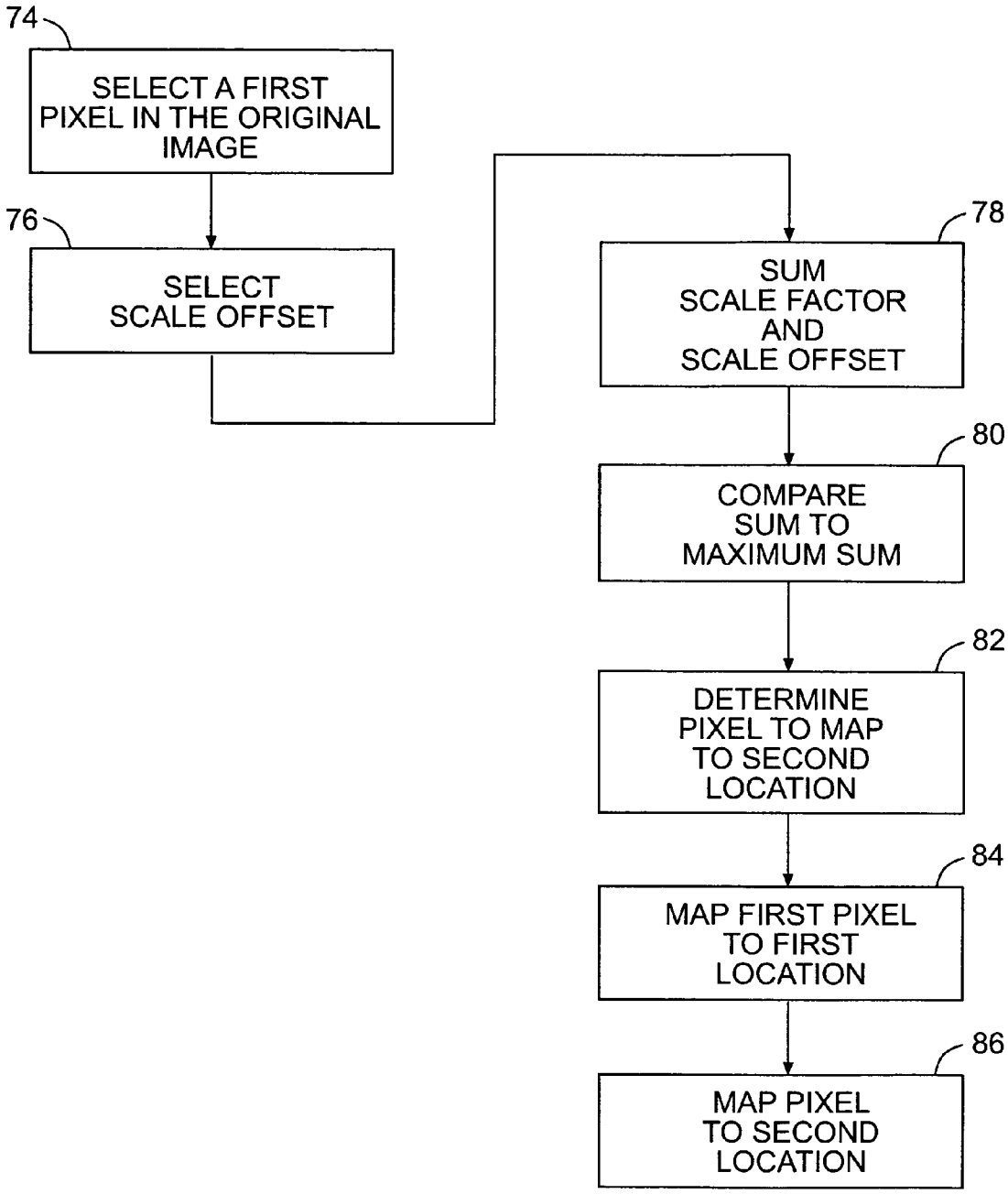
FIG. 12 illustrates the steps in a method of providing of pixel replication sequences.

Referring to FIG. 12, the steps 74-86 elaborate on the step 68 of providing a set of pixel replication sequences for each of the scale factors.

In a step 74, a first pixel in the original image is selected.

In a step 76, a scale offset parameter is selected. For example, in the pixel replication sequences 94 and 36*c*, the scale offset parameter selected is 50.

In a step 78, the scale factor and the scale offset parameter are added, producing a sum.

In a step 80, the sum is compared to a maximum sum, such as 255.

Step 82 uses the result of the comparison of step 80. In a step 82, the pixel in the original image to be mapped into a second pixel location of the enlarged image is determined. If the first sum is less than or equal to the maximum sum, the first pixel selected in step 74 is mapped into the second pixel location. On the other hand, if the first sum is greater than the maximum sum, a second pixel in the original image is selected and mapped into the second pixel location.

In a step 84, the first selected pixel is mapped into a first location in the enlarged image.

In a step 86, the pixel determined in step 82 to be mapped into the second location is mapped into that location in the enlarged image.

The invention is also directed to a machine readable medium, such as magnetic or optical disks, hard disk drives, memory chips, and other similar memory devices. The medium embodies a program of instructions that may be executed by a machine, such as a computer system. The program of instructions may be software, firmware, hardware code, or other similar program. When the machine executes the program, it performs a method in accordance with the principles of the invention, such as the preferred method described above.

The invention has been illustrated with graphics controller having an embedded memory. The principles of the invention may be practiced in any digital device. Moreover, the memory need not be located on the same integrated circuit as the enlarging circuit.

The invention has been illustrated with an original image stored in a memory. In other embodiments, the principles of the invention may be applied to streaming image data not stored in a memory. For example, in one embodiment for expanding streaming image data, the image data is expanded in only one dimension, such as vertically.

In a preferred embodiment, a 9-bit adder is employed in the enlarging circuit and the scale offset preferably takes values between 0 and the scale factor. In an alternative embodiment, the scale offset used with the 9-bit adder may take values greater than the scale factor. Further, the invention is not limited to an enlarging circuit which uses a 9-bit adder. Smaller or larger adders may be used.

In a preferred embodiment, when the expression: scale factor+1+[previous sum or scale offset] is evaluated, the inclusion of the integer 1 permits the use of an 8-bit scale factor. While preferred, the inclusion of the integer 1 is optional.

The invention has been illustrated with an enlarging circuit for dynamically creating pixel replication sequences. In an alternative embodiment, sets of pixel replication sequences for each of the plurality of scale factors may be stored in a memory. In this embodiment the enlarging circuit may be eliminated.

The invention has been illustrated with a display device. But, any similar or equivalent device for rendering an image comprised of pixels, such as an LCD, a CRT, an OLED, a plasma display, or any similar or equivalent device. Further, the display device may be a printer or any other similar or equivalent device for rendering hard copy images.

The invention has been illustrated with an image capture device 44. In specific embodiments, the image capture device may be a charge coupled device and associated circuitry, a digital camera, a digital scanner, or other similar device.

The terms and expressions that have been employed in the foregoing specification are used as terms of description and not of limitation, and are not intended to exclude equivalents of the features shown and described or portions of them. The scope of the invention is defined and limited only by the claims that follow.

The invention claimed is:

1. A method for expanding image data for display in which enlarged images are created from an original image comprising:

providing a plurality of scale factors, each for defining a particular degree of enlargement of the original image;

providing a plurality of sets of pixel replication sequences, one set being provided for each of the scale factors, each set including at least two pixel replication sequences;

selecting a scale factor from the plurality of scale factors;

selecting a pixel replication sequence from the set of pixel replication sequences for the selected scale factor, wherein the pixel replication sequence is selected so that a selected one of the pixels in the original image is mapped to a particular location in the enlarged image;

selecting a first pixel of the original and mapping the selected first pixel into a first pixel location in the enlarged image;

selecting a scale offset parameter;

adding the selected scale factor to the selected scale offset, producing a first sum;

comparing the first sum to a maximum sum; and determining a pixel of the original image to be mapped into a second pixel location in the enlarge image based on a result of the comparison.

2. The method of claim 1, wherein the selected first pixel is the pixel which is determined to be mapped into a second pixel location in the enlarged image if the first sum is less than the maximum sum.

3. The method of claim 2, further comprising:

adding the scale factor to the first sum, producing a second sum;

comparing the second sum with the maximum sum; and determining a pixel of the original image to map into a third pixel location in the enlarged image, wherein the selected first pixel is the pixel which is determined to be mapped into the third pixel location if the second sum is less than the maximum sum.

4. The method of claim 2, further comprising:

adding the scale factor to the first sum, producing a second sum;

comparing the second sum with the maximum sum;

selecting a second pixel of the original image; and determining a pixel of the original image to map into a third pixel location in the enlarged image, wherein the selected second pixel is the pixel which is determined to be mapped into the third pixel location if the second sum is greater than the maximum sum.

5. The method of claim 1, further comprising selecting a second pixel of the original image, wherein the selected second pixel is the pixel which is determined to be mapped into a second pixel location in the enlarged image if the first sum is greater than the maximum sum.

6. The method of claim 5, further comprising:

adding the scale factor to the first sum, producing a second sum;

comparing the second sum to the maximum sum; and determining a pixel of the original image to map into a third pixel location in the enlarged image, wherein the selected second pixel is the pixel which is determined to be mapped into the third pixel location if the second sum is less than the maximum sum.

7. The method of claim 5, further comprising:

adding the scale factor to the first sum, producing a second sum;

comparing the second sum to the maximum sum; and selecting a third pixel of the original image;

determining a pixel of the original image to map into a third pixel location in the enlarged image, wherein the selected third pixel is the pixel determined to be mapped into the third pixel location if the second sum is greater than the maximum sum.

8. A computer-readable medium having a program of instructions stored on the medium, the instructions being executable by a machine, wherein, when the instruction are accessed by the machine, the machine performs a method for expanding image data for display in which enlarged images are created from an original image, comprising:

providing a plurality of scale factors, each for defining a particular degree of enlargement of the original image;

providing a plurality of sets of pixel replication sequences, one set being provided for each of the scale factors, each set including at least two pixel replication sequences;

selecting a scale factor from the plurality of scale factors;

selecting a pixel replication sequence from the set of pixel replication sequences for the selected scale factor, wherein the pixel replication sequence is selected so that a selected one of the pixels in the original image is mapped to a particular location in the enlarged image;

selecting a first pixel of the original image and mapping the selected first pixel into a first pixel location in the enlarged image;

selecting a scale offset parameter;

adding the selected scale factor to the selected scale offset, producing a first sum;

comparing the to a maximum sum; and determining a pixel of the original image to be mapped into a second pixel location in the enlarged image based on a result of the comparison.

9. The computer readable medium of claim 8, wherein the selected first pixel is the pixel which is determined to be mapped into a second pixel location in the enlarged image if the first sum is less than the maximum sum.

10. The machine readable medium of claim 9, the method further comprising:

adding the scale factor to the first sum, producing a second sum;

comparing the second sum with the maximum sum; and determining a pixel of the original image to may into a third pixel location in the enlarged image, wherein the selected first pixel is the pixel which is determined to be mapped into the third pixel location if the second sum is less than the maximum sum.

11. The computer readable medium of claim 9, the method further comprising:

adding the scale factor to the first sum, producing a second sum;

comparing the second sum with the maximum sum;

selecting a second pixel of the original image; and determining a pixel of the original image to map into a third pixel location in the enlarged image, wherein the selected second pixel is the pixel which is determined to be mapped into the third pixel location if the second sum is greater than the maximum sum.

12. The computer readable medium of claim 8, the method further comprising selecting a second pixel of the original image, wherein the selected second pixel is the pixel which is determined to be mapped into a second pixel location in the enlarged image if the first sum is greater than the maximum sum.

13. The computer readable medium of claim 12, the method further comprising:

adding the scale factor to the first sum, producing a second sum;

comparing the second sum to the maximum sum; and determining a pixel of the original image to map into a third pixel location in the enlarged image, wherein the selected second pixel is the pixel which is determined to be mapped into the third pixel location if the second sum is less than the maximum sum.

14. The computer readable medium of claim 12, the method further comprising:

adding the scale factor to the first sum, producing a second sum;

comparing the second sum to the maximum sum;

selecting a third pixel of the original image; and determining a pixel of the original image to map into a third pixel location in the enlarged image, wherein the selected third pixel is the pixel determined to be mapped into the third pixel location if the second sum is greater than the maximum sum.

15. An apparatus for expanding image data for display and for maintaining a selected pixel of an original image at a particular location in an enlarged image, comprising a circuit to select ordered pixels of the original image and to map successively selected pixels to ordered pixel locations in the enlarged image, wherein the circuit:

initially selects an initial pixel of the original image and maps the selected initial pixel into a first pixel location in the enlarged image; and selects pixels of the original image which follow the first pixel location for mapping to the ordered pixel locations in the enlarged image by:

(a) iteratively producing a sum and comparing a currently produced sum to a maximum sum to determine a pixel of the original image to be mapped into one of the pixel locations in the enlarged image, wherein the sum is produced by summing a scale factor and a selected scale offset parameter in a first iteration, and by summing the scale factor and a sum produced in an immediately preceding iteration in subsequent iterations, and (b) determining that a first pixel selected in an immediately preceding iteration is the pixel to be mapped into a current pixel location in the enlarged image if the sum produced in a current iteration is less than the maximum sum, and otherwise that a selected second pixel of the original image is the pixel to be mapped into the current pixel location.

16. The apparatus of claim 15, wherein the scale factor is selectable.

17. The apparatus of claim 15, wherein the scale factor is a non-integer scale factor.

18. The apparatus of claim 15, further comprising a memory to store the original image, wherein the circuit generates an address in the memory for each pixel of the original image selected to be mapped into a pixel location in the enlarged image.

19. The apparatus of claim 15, further comprising an adder circuit to produce and compare the sums.

20. The apparatus of claim 19, wherein the sum is produced by summing a scale factor, the number one, a selected scale offset parameter in a first iteration, and by summing the scale factor, the number one, and a sum produced in an immediately preceding iteration in subsequent iterations.

21. The apparatus of claim 15, wherein the enlarged image is rendered on a display device having a resolution which is substantially the same as the resolution of the original image.

22. A system for expanding image data for display and for maintaining selected pixel of an original image at a particular location in an enlarged image, comprising:

a controller including:

a memory to store the original image, and a circuit to select ordered pixels of the original image and to map successively selected pixels to ordered pixel locations in the enlarged image, wherein the circuit;

initially selects an initial pixel of the original image and maps the selected initial pixel into a first pixel location in the enlarged image, and selects pixels of the original image which follow the first pixel location for mapping to the ordered pixel locations in the enlarged image by:

(a) iteratively producing a sum and comparing a currently produced sum to a maximum sum to determine a pixel of the original image to be mapped into one of the pixel locations in the enlarged image, wherein the sum is produced by summing a scale factor and a selected scale offset parameter in a first iteration, and by summing the scale factor and a sum produced in an immediately preceding iteration in subsequent iterations, and (b) determining that a first pixel selected in an immediately preceding iteration is the pixel to be mapped into a current pixel location in the enlarged image if the sum produced in a current iteration is less than the maximum sum, and otherwise that a selected second pixel of the original image is the pixel to be mapped into the current pixel location;

a CPU; and a display device to render original and enlarged images.

23. The system of claim 22, wherein the display device has a resolution which is substantially the same as the resolution of the original image.

24. The system of claim 22, wherein the display device is a printer.

25. The system of claim 22, further comprising an adder circuit to produce and compare the sums.

* * * * *

UNITED STATES PATENT AND TRADEMARK OFFICE

CERTIFICATE OF CORRECTION

PATENT NO. : 7,355,610 B2
APPLICATION NO. : 10/926732
DATED : April 8, 2008
INVENTOR(S) : Atousa Soroushi It is certified that error appears in the above-identified patent and that said Letters Patent is hereby corrected as shown below:

Column 12,
Line 17, please change "of the original and" to --of the original image and--.

Column 13,
Line 31, please change "comparing the to a" to --comparing the first sum to a--.

Column 13,
Line 44, please change "image to may into" to --image to map into--.

Signed and Sealed this

Twenty-ninth Day of July, 2008

JON W. DUDAS
*Director of the United States Patent and Trademark Office*